US010482683B2

(12) United States Patent
Harvey et al.

(10) Patent No.: US 10,482,683 B2
(45) Date of Patent: Nov. 19, 2019

(54) WATER INGRESS PROTECTION FOR TICKET ENTRY SLOT

(71) Applicant: Cubic Corporation, San Diego, CA (US)

(72) Inventors: John Michael Harvey, Chessington (GB); Mark Barry Pottinger, Newick (GB); Darryl Meek, Pease Pottage (GB); Thomas Barrack, Maidenbower (GB); Trevor Kingsley Brown, East Hoathly (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/130,228

(22) Filed: Sep. 13, 2018

(65) Prior Publication Data

US 2019/0080522 A1 Mar. 14, 2019

Related U.S. Application Data

(60) Provisional application No. 62/558,244, filed on Sep. 13, 2017.

(51) Int. Cl.
*G07B 11/02* (2006.01)
*G07B 5/04* (2006.01)

(52) U.S. Cl.
CPC ..... *G07B 11/02* (2013.01); *G07B 5/04* (2013.01)

(58) Field of Classification Search
CPC ..... G07B 11/02; G07B 5/04; G07D 11/14
(Continued)

(56) References Cited

U.S. PATENT DOCUMENTS 4,513,439 A 4/1985 Gorgone et al.
5,577,287 A * 11/1996 Olson ..... A63F 3/068 15/236.01

(Continued)

FOREIGN PATENT DOCUMENTS

JP H03-93978 U 9/1991
JP 2000-149122 A 5/2000

(Continued)

OTHER PUBLICATIONS

International Search Report and Written Opinion dated Dec. 12, 2018 for International Patent Application No. PCT/US2018/050836, filed Sep. 13, 2018, all pages.

*Primary Examiner* — Rakesh Kumar
(74) *Attorney, Agent, or Firm* — Kilpatrick Townsend & Stockton LLP

(57) ABSTRACT

A ticket validation device that is protected from debris ingression includes a validator housing defining a ticket entry bezel. The ticket entry bezel defines a first and second major sides and shorter connecting regions that connect the two major sides. The device includes an acceptor assembly that transports a ticket to a ticket reader device and at least one flap positioned between the acceptor assembly and the ticket entry bezel. The flap is biased against one of the first major side or the second major side of the entry bezel. A ticket-side of the flap is pushed away from the one of the major sides by the ticket when inserted into the ticket entry bezel such that the ticket scrapes between a distal end of the flap and the one of the major sides to remove any loose debris from the ticket prior to the ticket reaching the acceptor assembly.

9 Claims, 16 Drawing Sheets

(58) Field of Classification Search
USPC ..... 221/26; 194/206
See application file for complete search history.

(56) References Cited

U.S. PATENT DOCUMENTS

| | | | | | |
|---|---|---|---|---|---|
| 5,639,081 | A * | 6/1997 | Hatamachi | B65H 29/46 | 271/177 |
| 5,887,695 | A * | 3/1999 | Hatamachi | B65H 29/46 | 194/207 |
| 8,064,814 | B2 * | 11/2011 | Kagawa | G03G 15/2025 | 399/327 |
| 2004/0011619 | A1 * | 1/2004 | Yoshioka | G07D 7/00 | 194/206 |
| 2010/0061778 | A1 * | 3/2010 | Kagawa | G03G 15/2025 | 399/327 |
| 2019/0080522 | A1 * | 3/2019 | Harvey | G07B 5/04 | |

FOREIGN PATENT DOCUMENTS

| | | | |
|---|---|---|---|
| JP | 2000-182090 | * | 6/2000 |
| JP | 2000-182090 | A | 6/2000 |
| JP | 3639332 | B2 | 4/2005 |

* cited by examiner

WATER INGRESS PROTECTION FOR TICKET ENTRY SLOT

CROSS-REFERENCES TO RELATED APPLICATIONS

This Application claims priority to U.S. Provisional Patent Application No. 62/558,244, filed Sep. 13, 2017, entitled "WATER INGRESS PROTECTION FOR TICKET ENTRY SLOT," the entire disclosure of which is hereby incorporated by reference, for all purposes, as if fully set forth herein.

BACKGROUND OF THE INVENTION

Ticket validation in transit systems enables a transit system to track passengers and payments within the transit system. Such functionality lies at the heart of transit systems. Some transit systems use "pass through" validators with entry slots into which tickets (typically a physical medium with a paper or plastic substrate onto which ticket information is encoded visually, magnetically, and/or otherwise written) are inserted, and a separate exit slot out of which tickets are then collected by the passenger. The tickets travel inside the validators from the entry slot to the exit slot, during which information is extracted from the ticket and the ticket is validated. Depending on the type of entry gate in which the validator is used, a physical barricade or other entry-limiting mechanism may be moved (automatically or manually by the passenger) once the ticket is validated. Among other advantages, these validators can quickly validate tickets to help preserve and promote a paced throughput (e.g., 33 passengers per minute or other rate) through entry gates and/or exit gates.

These validators, however, have limitations. Because tickets enter into the validators through external openings, the validators are susceptible to water, dirt, and other debris that enters the slot. Thus, pass-through validators have rarely been used outdoors, where there is an increased likelihood that water and/or other debris will enter the validator. Improvements in preventing debris ingression in such validation systems is desired.

BRIEF SUMMARY OF THE INVENTION

Embodiments of the present invention are directed to validation devices that are protected from ingression from water, dirt, and/or other debris. Embodiments of the invention achieve the debris-blocking results by incorporating at least one flap at each of the ticket bezels. These flaps are biased to contact an interior surface of a ticket bezel such that the flaps essentially form a seal with the bezel to protect the interior of the validation device from water and/or other debris. As a ticket is inserted into the bezel, the ticket contacts the flap and displaces the flap just enough so that the ticket may be pushed past the flap into engagement with an acceptor device, with the distal edge of the flap serving to scrape any loose debris off the surface of the ticket as the ticket passes between the flap and the interior surface of the bezel.

In one embodiment, a ticket validation device that is protected from debris ingression is provided. The validation device may include a validator housing defining a ticket entry bezel. The ticket entry bezel may define a first major side, a second major side positioned opposite the first major side, and shorter connecting regions that extend between the first major side and the second major side. The validation device may also include an acceptor assembly configured to transport a ticket to a ticket reader device and at least one flap positioned between the acceptor assembly and the ticket entry bezel. The at least one flap may be biased against one of the first major side or the second major side of the ticket entry bezel. A ticket-side of the at least one flap may be configured to be pushed away from the one of the first major side and the second major side by the ticket when inserted into the ticket entry bezel such that the ticket scrapes between a distal end of the at least one flap and the one of the first major side and the second major side to remove any loose debris from the ticket prior to the ticket reaching the acceptor assembly.

In another embodiment, a ticket validation device that is protected from debris ingression includes a validator housing defining a ticket entry bezel. The ticket entry bezel may define a first major side, a second major side positioned opposite the first major side, and shorter connecting regions that extend between the first major side and the second major side. The validation device may also include an acceptor assembly configured to transport a ticket to a ticket reader device and a first flap and a second flap positioned between the acceptor assembly and the ticket entry bezel. The first flap and the second flap may be biased in a direction of one of the first major side or the second major side of the entry bezel. A ticket-side of the flap may be configured to be pushed away from the one of the first major side and the second major side by the ticket when inserted into the ticket entry bezel such that the ticket scrapes between a distal end of the first flap and the one of the first major side and the second major side to remove any loose debris from the ticket prior to the ticket reaching the acceptor assembly.

In another embodiment, a method for protecting a validation device from debris ingression is provided. The method may include receiving a ticket within a ticket entry bezel of the validation device, displacing at least one flap positioned proximate the ticket entry bezel by insertion of the ticket through the ticket entry bezel, and removing any loose debris on the ticket by the at least one flap. The at least one flap may be mechanically biased against one of a first major side or a second major side of the entry bezel. The method may also include receiving the ticket at an acceptor assembly positioned interiorly of the at least one flap and transporting the ticket to a ticket reader device of the validation device. The method may further include reading data from the ticket.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
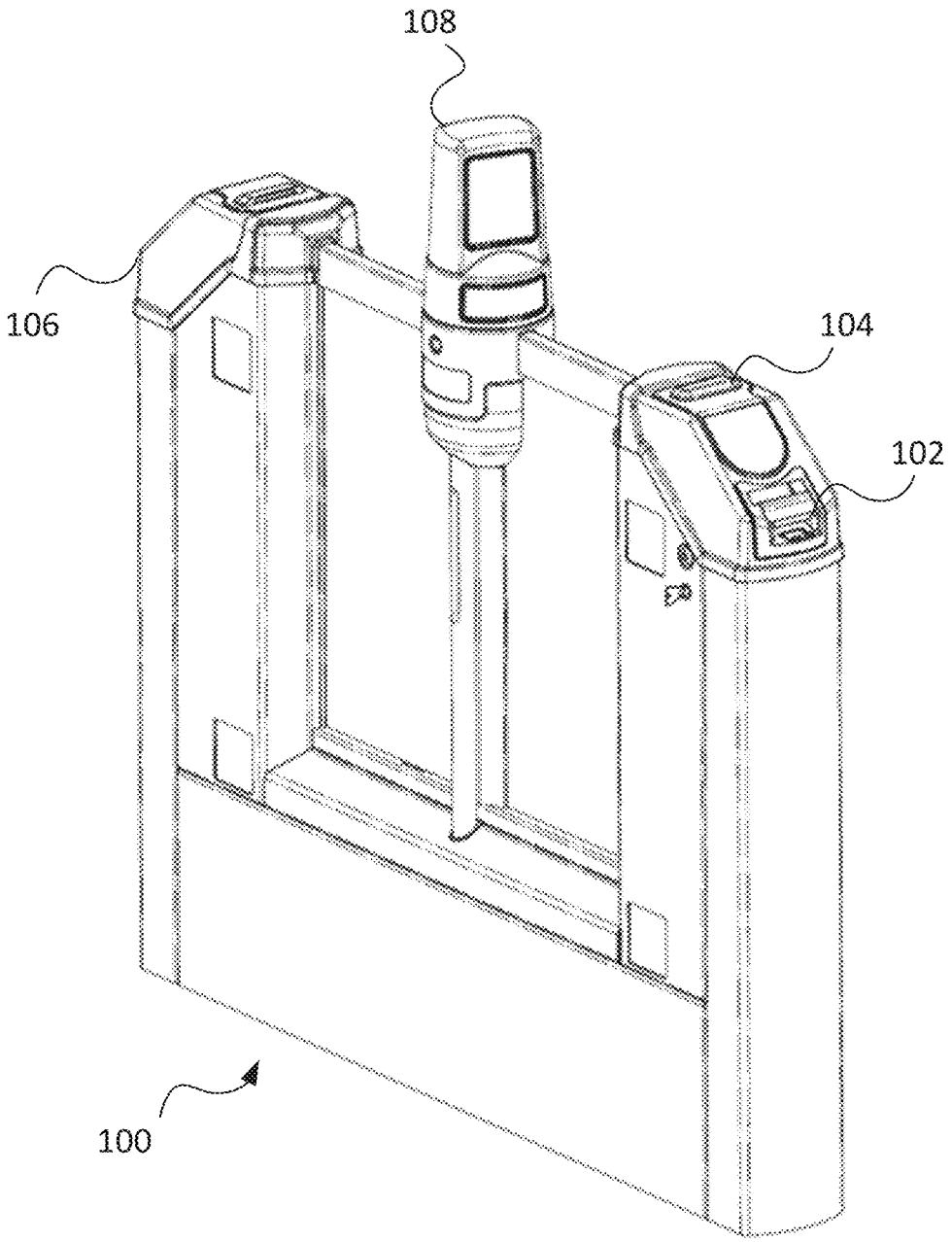
FIG. 1 depicts a validation device according to embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention(s) described herein are generally related to ticket reading machines for transit systems, although it will be understood that alternative embodiments may have applications elsewhere such as, but not limited to, theaters, stadiums, parking ticket machines, and/or other applications. While particularly directed to "pass through" validators, it will be appreciated that the techniques described herein may be applied to both pass through and non-pass through validation devices. In addition, while primarily discussed in relation to ticket validation devices, the present inventions may be applicable to any application in which an item is inserted within a device for subsequent validation and/or payment. For the purposes of the present disclosure, ticket refers to a ticket, payment card, access credential, currency, check, data storage card, and/or other tangible storage media that may be inserted into a validation device for subsequent reading and validation of data. For example, embodiments of the present invention may be applicable to vending machines, payment machines, automated teller machines, and/or other machines that are configured to receive tickets, currency, cards and/or other items for validation therein.

Embodiments of the present invention are directed to preventing water and/or other debris from entering a validation device, as such debris has the potential to damage the validation device. In particular, embodiments include strategically fitting low-cost flaps to the validation device to cover and effectively seal bezel apertures. The flaps operate by bending in the direction of the ticket (or other media) travel. According to some embodiments, two flaps are utilized to provide sufficient resistance to keep water out of the validation device at a rating of IPX4 from BSEN60529-1992_A2 2013. Having two flaps allows the flap surfaces to move independently of one another and offer adequate protection while enabling ticket passage. Due to the flap being configured to bend in the direction of ticket passage, the exit bezel naturally moves outward to enable the exit of the ticket. Water pressure trying to get into the exit bezel pushes against the flap, while the flap acts as a seal to prevent water or other debris from entering the validation device. In some embodiments, only one flap is need for the exit bezel.

Among other advantages, embodiments of the invention can enable a ticket validation system (e.g., for validation magnetic stripe, magnetic ink, optical data, and/or other tickets and/or media) to be fitted outdoors. In particular, embodiments provide resistance to water entry but allow tickets to pass through. The flaps utilized aid in limiting water ingression by scraping water (and/or other debris) from the tickets as the flaps provide a spring-loaded edge that is parallel (or at another angle) relative to the bezel mold which a potentially wet ticket passes through. The flaps similar prevent dirt and other materials from entering the validation device. Advantageously, the flaps may be retrofitted to current installations.

In some embodiments, a blower may be placed inside a validation device to remove excess water. In such embodiments, the water may need to be removed quickly to keep a certain rate (e.g., 33 people per minute) of people passing through an entry and/or exit gate. Moreover, the water may need to be channeled away from potential hazardless and/or susceptible areas of the validation device.

Turning now to FIG. 1, one example of a validation device 100 is shown. Validation device 100 may be a transit ticket gate or other validator, a vending machine, a parking pass validator, ATM, and/or other device that receives and validates tickets and/or other items. In some embodiments, the validation device 100 may be a pass through device, in which a ticket or other media to be validated is inserted into the validation device and, upon generating a validation result, ejects the ticket or other media from a different aperture. In other embodiments, the validation device 100 may be a device that receives and retains tickets or other media upon validating the media.

In pass through embodiments, the validation device 100 includes an entry bezel 102 that is configured to receive tickets and/or other media and an exit bezel 104 that is configured to eject tickets and/or other media upon validation of the media. For example, a user may insert a ticket, payment, and/or other media into the entry bezel 102. The media may be drawn into the validation device 100, where data is read from the media. Upon reading the data (and validating the data), the validation device 100 may eject the ticket from the exit bezel 104 such that the user may retrieve the media for further usage. In some embodiments, such as shown in FIG. 1, the validation device 100 may be bidirectional, such that a particular validation device 100 may be used as an entry gate and/or an exit gate. Oftentimes the entry/exit status of the validation device 100 may be based on which direction of user flow is heaviest at any given point in time, and the status may be changed at any point. In embodiments in which the validation device 100 is bidirectional, the validation device 100 may include an entry bezel 102 and an exit bezel 104 at each end. For example, each end of the validation device 100 may include a nose assembly 106 that houses a respective entry bezel 102 and exit bezel 104. While shown here with both entry bezel 102 and exit bezel 104 being provided on a nose assembly 106, it will be appreciated that other arrangements are possible. For example, the entry bezel 102 may be positioned at an end of the validation device 100, while the exit bezel 104 may be positioned at a more central location and/or at an opposite end of the validation device 100 from the entry bezel 102. Such arrangements enable a user to insert their ticket into the entry bezel 102 and keep passing through the validation device 100 while the ticket (or other media) is validated. After the ticket is validated the ticket may be ejected at the exit bezel 104, which is positioned downstream of the entry bezel 102 such that the user may retrieve the ticket after having progressed to a further position along the validation device 100. Such designs may help increase passenger/user throughput as the user need not stop and wait for the ticket to be validated since the ticket moves within the validation device 100 to the exit bezel 104 at a rate that is the same or similar to the rate the user walks.

In non-pass through embodiments, the validation device 100 may have only a single entry bezel 102, without any exit bezels 104. In some embodiments, once the ticket or other media that is inserted into the validation device 100 is validated, the validation device 100 may retain the ticket within a bin or other storage area of the validation device 100.

Figure 2:
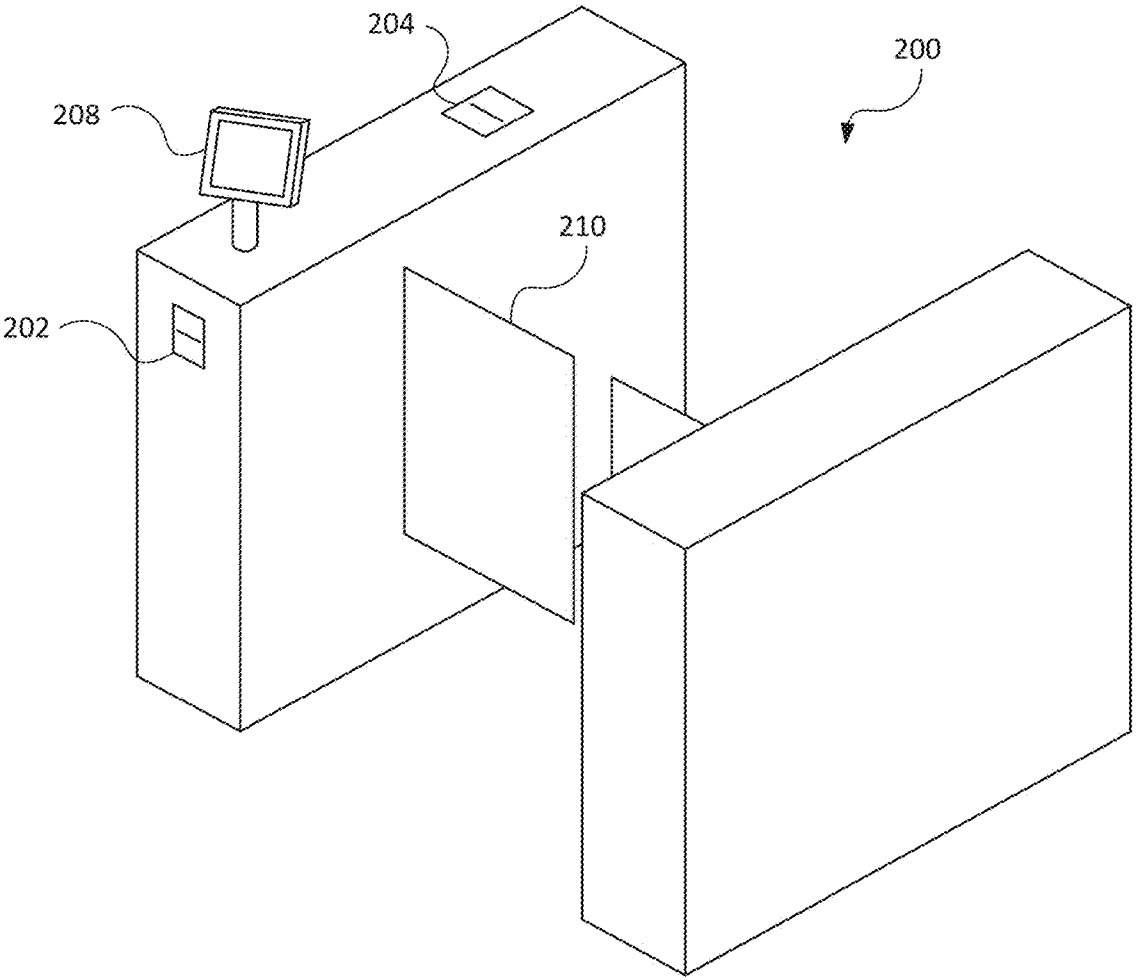
FIG. 2 depicts a validation device according to embodiments.

The validation device 100 may also include at least one feedback device 108, which may provide audio and/or visual feedback to user. For example, the feedback device 108 may include one or more lights, display screens, and/or other visual feedback devices. The feedback device 108 may also (or alternatively) include one or more speakers and/or other audio feedback devices. The feedback device 108 may be configured to light up, display a message, make a sound, and/or deliver an audio message based on the result of validation. For example, upon a successful validation, a green light may be illuminated, a message to proceed may be displayed, a message regarding a remaining balance may be displayed, a chime sound may be emitted, an audible message to proceed may be emitted, and/or other positive feedback may be produced by the feedback device 108. Similarly, upon a failed or otherwise unsuccessful validation, a red light may be illuminated, a message to stop and/or try again may be displayed, a message regarding a deficient balance may be displayed, a buzzer sound may be emitted, an audible message to stop and/or retry validation may be emitted, and/or other negative feedback may be produced by the feedback device 108. In some embodiments, the feedback device 108 may also (or alternatively) be configured to provide haptic feedback, such as vibrations and/or patterns of vibration that indicate a particular validation result. In some embodiments, the validation device 100 may include one or more barriers (as shown in FIG. 2), such as gates, turnstiles, paddles, and/or other physical barrier mechanisms.

Each validation device 100 may include a processing unit (not shown), which may include one or more processors that control the operation of the validation device 100. For example, the processor may instruct the feedback device to generate particular visual, audio, and/or haptic feedback in response to a particular validation result. The processor may also control the reception and validation of data (either locally or through a central validation office/system). The processor may also control the actuation of any barriers of the validation device.

Figure 1A:
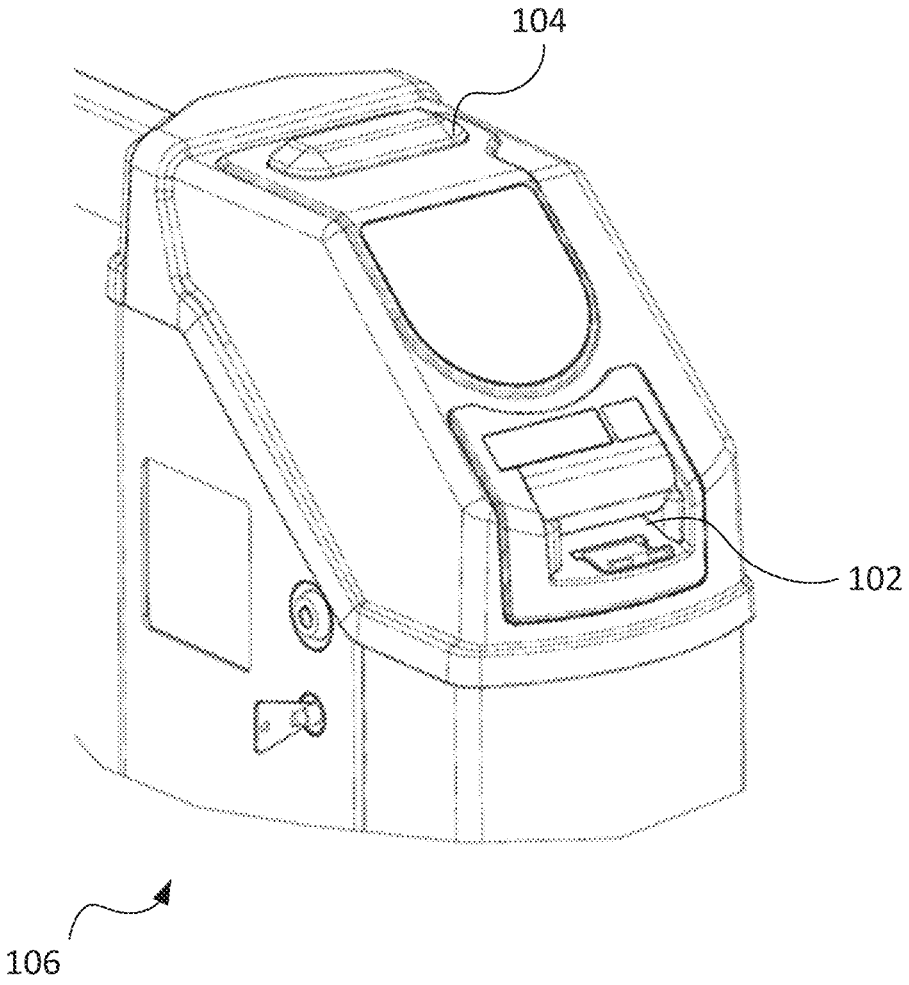
FIG. 1A depicts a nose assembly of the validation device of FIG. 1.

FIG. 1A depicts the nose assembly 106 of validation device 100. In some embodiments, the nose assembly 106 may considered to be part of the body or housing of the validation device 100. In the present embodiment, the nose assembly 106 includes an entry bezel 102 positioned near a front end of the nose assembly 106 and an exit bezel 104 on a rear, top surface of the nose assembly 106. The entry bezel 102 may be positioned in a generally horizontal orientation such that a ticket or other media is horizontally inserted within the entry bezel 102. Such designs may be particularly useful for entry bezels 102. For example, at the entry bezel 102 the inward movement of the ticket is more likely to push or otherwise move water and/or other debris into the validation device 100. When the entry bezel 102 is horizontally oriented, gravity does not aid the water and/or other debris in entering the validation device 100, making it easier to keep water and/or other debris out. While advantageous to orient the entry bezel 102 in a horizontal manner, it will be appreciated that other arrangements of the entry bezel 102 are possible. Because the movement of the ticket or other media through the exit bezel 104 is in an outward direction, there is less risk of water and/or other debris from being drawn into the validation device 100, the exit bezel 104 may be oriented in a generally vertical direction, although other arrangements are possible. By positioning the exit bezel 104 on a top of the nose assembly 106, the ticket is ejected at a position that is convenient for retrieval by the user downstream of the entry bezel 102.

Figure 1B:
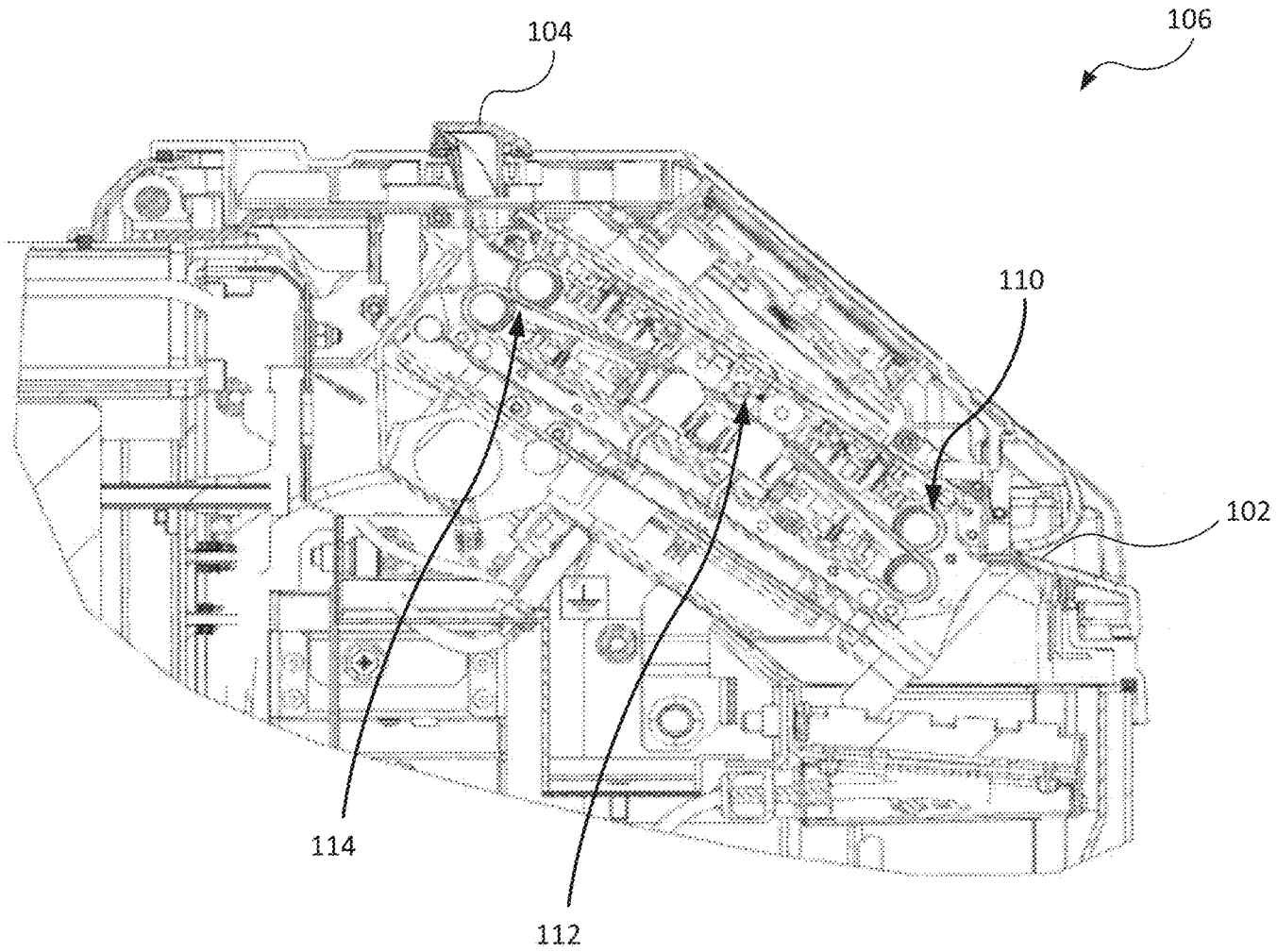
FIG. 1B is a cross-sectional view of the nose assembly of FIG. 1A.

FIG. 1B depicts a cross-sectional view of the nose assembly 106. Positioned between the entry bezel 102 and the exit bezel is an acceptor assembly 110 and a ticket reader device 112. The acceptor assembly 110 may be configured to transport a ticket or other media to the ticket reader device 112. For example, the acceptor assembly 110 may include any number of belts, rollers, and/or other mechanisms that grab the ticket or other media after it is inserted into the entry bezel 102 and transports the ticket to the ticket reader device 112. The ticket reader device 112 is designed to read data from the ticket or other media. For example, the ticket reader device 112 may be configured to read magnetically encoded data from a magnetic stripe card and/or magnetic ink data, such as that used on checks, currency, and some transit tickets. The ticket reader device 112 may be configured to read optical data that is written or otherwise provided on a particular ticket. Electronically encoded data, such as that stored on memory chips and other devices may be read by the ticket reader device 112. It will be appreciated that other types of data may be read by the ticket reader device 112 and that any combination of data readers may be included in the ticket reader device 112 to handle the needs of a particular application.

After the data is read from the ticket or other media, the ticket may be moved by a transport assembly 112 to a final destination. In non-pass through embodiments, the final destination may be a storage bin and/or other storage area that allows the tickets to be collected for storage, recycling, and/or other purposes. In pass through embodiments, the final destination may be the exit bezel 104. For example, the transport assembly 114 may include any number of rollers, belts, and/or other mechanisms that can grab and more the ticket. The transport assembly 114 may push the ticket out of the exit bezel 104, where it may be retrieved by the user.

FIG. 2 is alternative embodiment of a validation device 200. Validation device 200 may be similar to validation 100 and may include an entry bezel 202, exit bezel 204, and feedback device 208 that are similar to those described in relation to FIG. 1. As shown, validation device 200 does not include a nose assembly (although one may optionally be used) and instead the entry bezel 202 and exit bezel 204 are formed directly within a body and/or housing of the validation device 200. In the presently shown embodiment, the exit bezel 204 is positioned at a medial portion of the validation device 200, however other positions that are more upstream or downstream relative to the illustrated position are possible to achieve the desired throughput results.

Validation device 200 further includes one or more barriers 210, such as gates, turnstiles, paddles, and/or other physical barrier mechanisms. These barriers 210 may have a default state, such as unlocked/locked and/or unobstructing/obstructing. If the user has been successfully validated, the barrier 210 may be in an unlocked and/or obstructing state. In embodiments where such a state is not the default state, the validation device 200 may send a signal to the barrier 210 to switch the barrier 210 to the unlocked (in which a mechanical and/or electrical locking mechanism is disengaged such that the barrier 210 may be opened) and/or unobstructing state (with physical barrier mechanisms moved out of the path of the user) such that the user may pass and enter or exit the access controlled area. If the user has not been successfully validated, the barrier 210 may be in a locked (in which a mechanical and/or electrical locking mechanism prevents the barrier 210 from being opened) and/or obstructing state (with physical barrier mechanisms moved into of the path of the user). In embodiments where such a state is not the default state, the validation device 210 may send a signal to the barrier 210 to switch the barrier 210 to the locked and/or obstructing state such that the user may not enter or exit the access controlled area.

The validation device 200 may also include a processing unit (not shown), which may include one or more processors that control the operation of the validation device 200. The processor may control the visual, audio, and/or haptic feedback presented by the feedback device 206. The processor may also control the reception and validation of data (either locally or through a central validation office/system). The processor may also control the actuation of any barriers 210 of the validation device 200.

Figure 3:
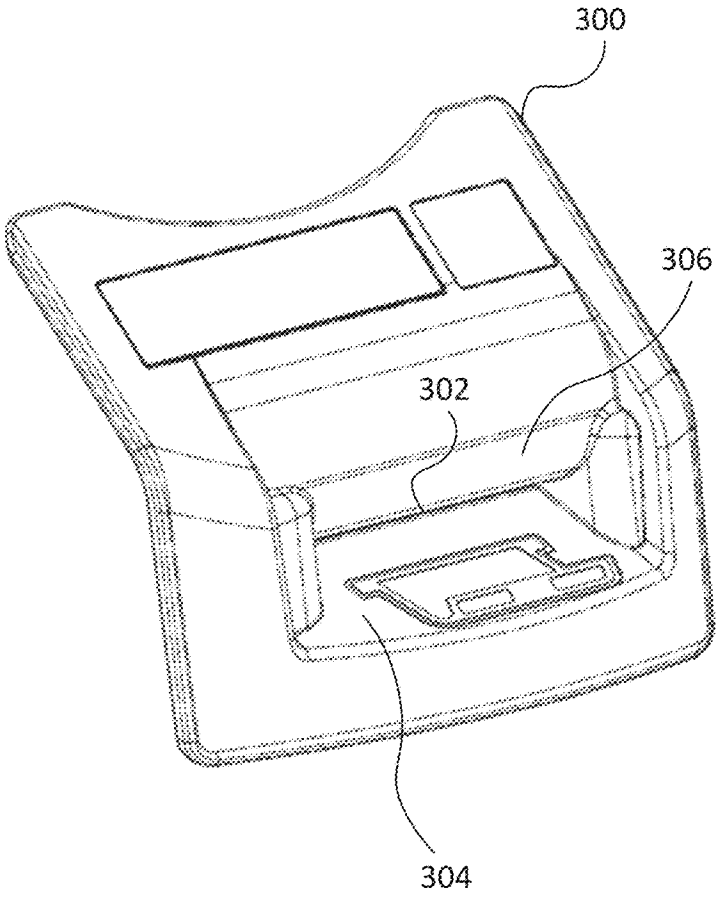
FIG. 3 depicts an entry bezel according to embodiments.

FIG. 3 depicts an entry bezel 300, similar to entry bezel 102 and/or 202. Entry bezel 300 may be formed on a nose assembly and/or other portion of a validation device housing. The entry bezel 300 may define a slot 302 through which tickets and/or other media may be inserted for subsequent validation. The entry bezel 300 and/or slot 302 be elongate and may include two major sides 314 that are connected by connecting regions 316 that extend between the major sides 314. For the purposes of this disclosure, a major side 314 is defined to mean a side having the largest length. For example, in embodiments where flat tickets, currency, and/or other generally flat media are accepted a major side 314 is one that is parallel to a face of the ticket, currency, and/or other media. Oftentimes, the entry bezel 300 is oriented such that the slot 302 is horizontal relative to the ground, although it will be appreciated that the slot 302 may be oriented in any manner depending on the desired application. As best seen in FIGS. 3C-3E, when in a horizontal orientation, the entry bezel 300 may include a downward sloping lower surface 304, with an upper surface 306 that overhangs at least a portion of the lower surface 304 such that the slot 302 is set inward from an outer edge of the upper surface 306 and an outer edge of the lower surface 304. This positioning provides a roof of sorts above the slot 302 to help prevent water and/or other debris from falling into the slot 302. Similarly, the sloped lower surface 304 directs water and/or other debris downward and away from the slot 302 to prevent the debris from entering the validation device.

Figure 3A:
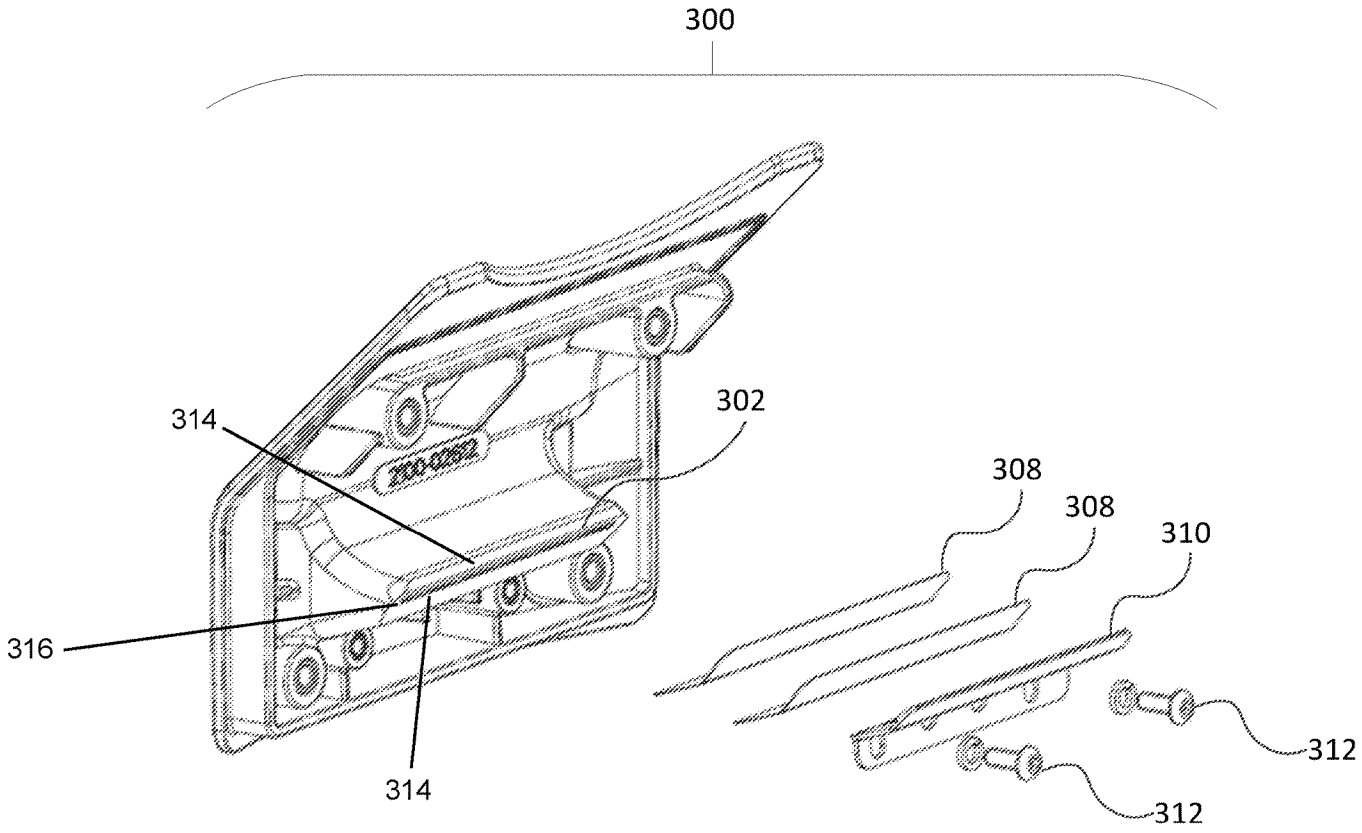
FIG. 3A is a rear exploded view of the entry bezel of FIG. 3.
Figure 3B:
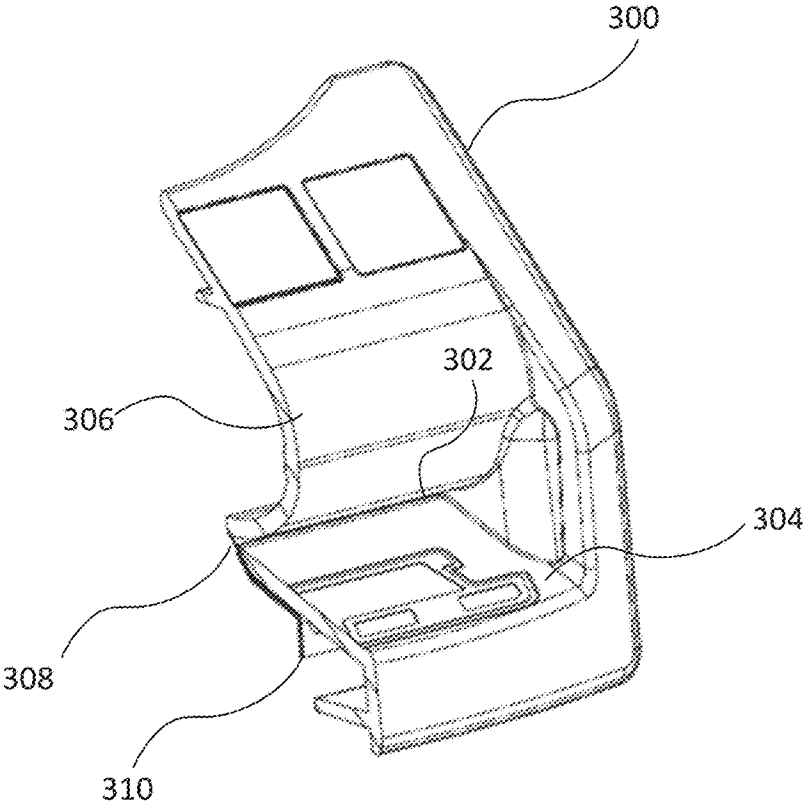
FIG. 3B is an isometric cross-sectional view of the entry bezel of FIG. 3.
Figure 3C:
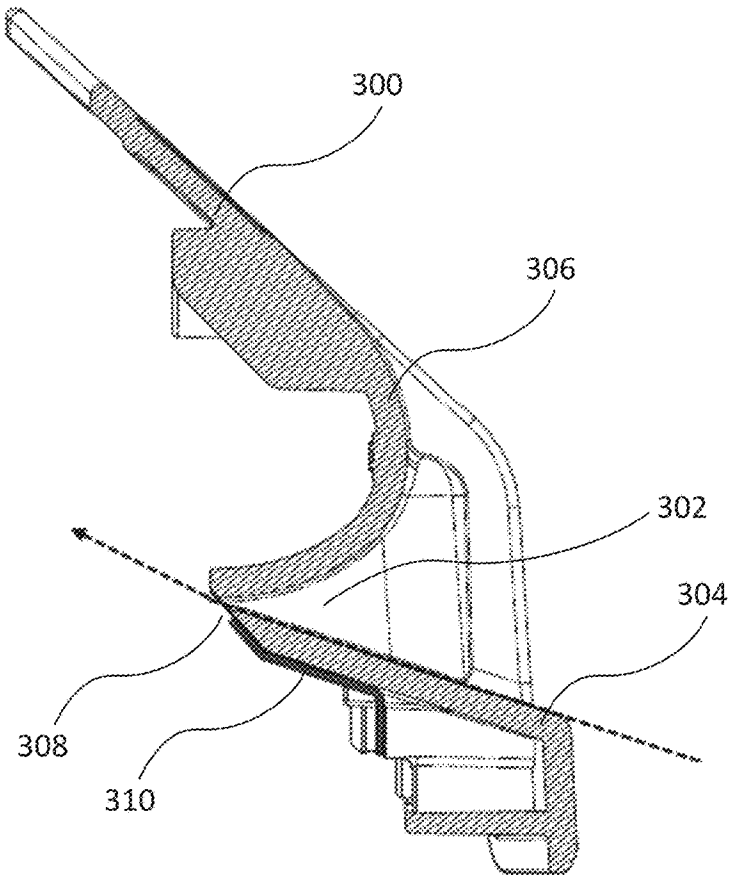
FIG. 3C is a side cross-sectional view of the entry bezel of FIG. 3.
Figure 3D:
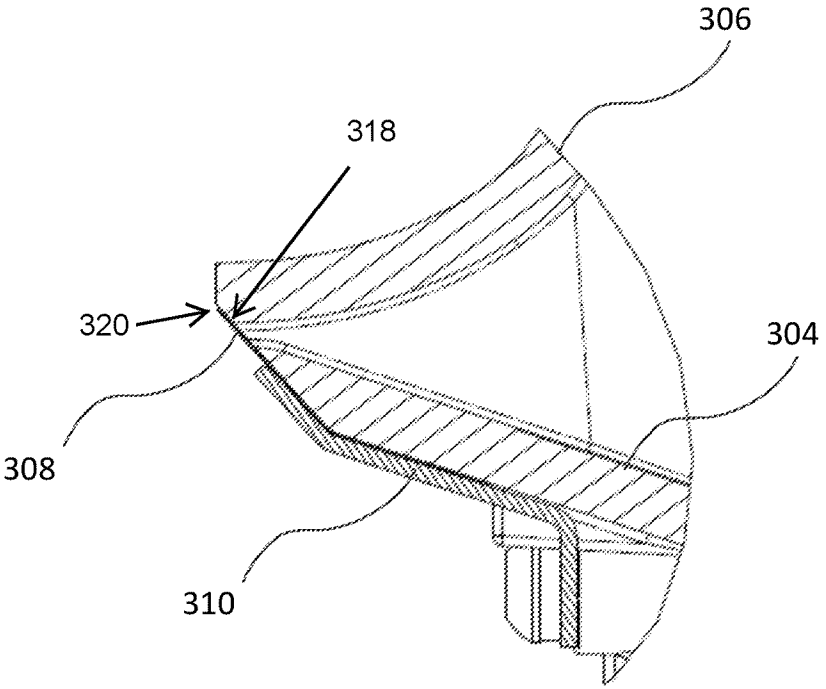
FIG. 3D is a side cross-sectional view of the entry bezel of FIG. 3.
Figure 3E:
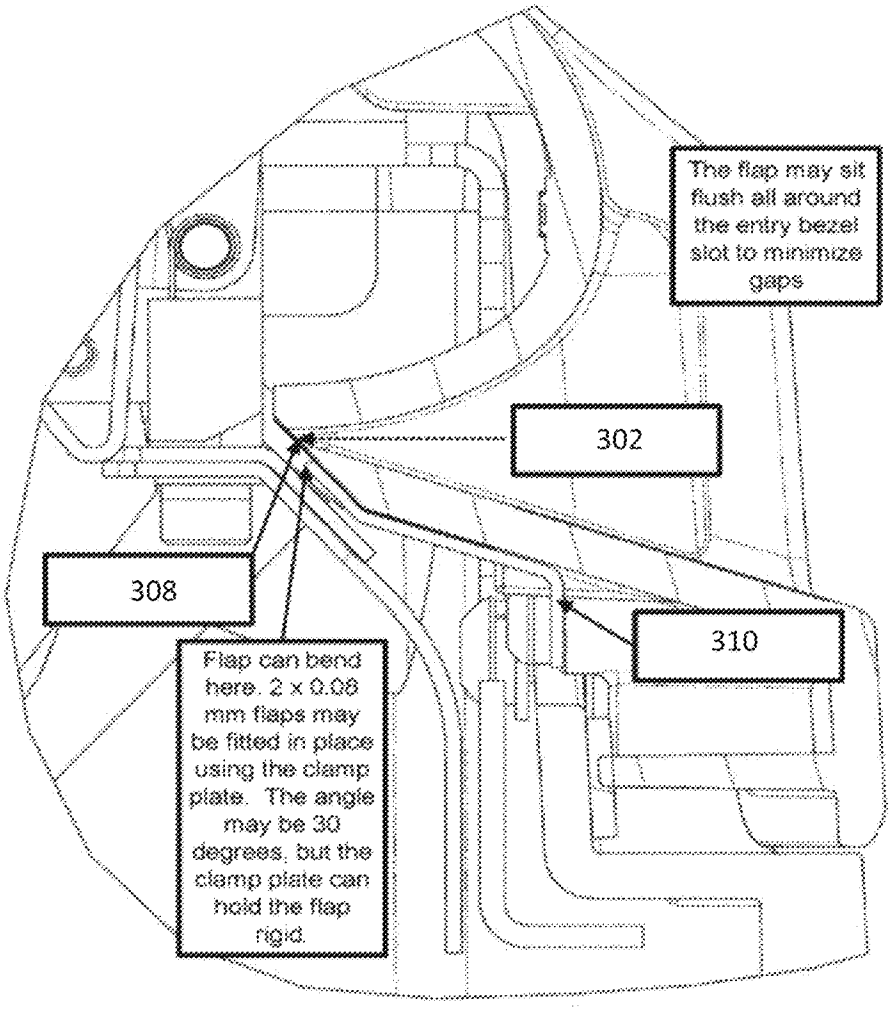
FIG. 3E is a side cross-sectional view of the entry bezel of FIG. 3.

FIG. 3A shows a rear exploded view of the entry bezel 300. Here, a number of flaps 308 are provided at a rear of the slot 302. While shown here with two flaps 308, it will be appreciated that one or more than two flaps 308 may also be used to fit the needs of a particular application. Here, flaps 308 are staggered such that a distal end 320 of one of the flaps 308 extends beyond a distal end of the other flap 308. The staggering may be very slight in some embodiments. Such an arrangement allows the flaps 308 to flex to allow the ticket to pass through the entry bezel 300 while still being sufficiently stiff to scrape any water and/or loose debris from the ticket and to return to the default position after the ticket has passed the flaps 308. Each of the flaps 308 may be formed of a metal, plastic, and/or other synthetic material, such as Mylar or a polycarbonate film. Each flap 308 may be between approximately 0.05 mm and 0.10 mm thick and oftentimes about 0.08 mm. By using thin Mylar (or similar material) flaps 308, a flap 308 with a proper combination of stiffness and low friction is provided that allows tickets to slide past a distal edge 320 of the flap(s) 308 while still being contacted by the flap 308 with sufficient force/tightness to scrape any water or other loose debris from the surface of the ticket. If more rigid and/or thicker flaps are utilized, the resulting stiffness of the flaps will prevent the flaps 308 from bending sufficiently to allow the ticket to pass beyond the flap 308, especially in situations where the ticket is wet and less stiff itself.

As illustrated here, flaps 308 may be bent such that each flap includes a distal end 320 that is at an angle relative to a mounting portion. The angle of the bend is typically between about 15 and 45 degrees, with a bend of about 30 degrees being common. However, the angle of the bend may be based on the geometry of the entry bezel 300. For example, angle of the bend may be set such that the distal end 320 of the flap 308 is at an acute angle relative to the major side 314 of the slot 302 that the distal end 320 contacts in a default state. In some embodiments, the flap(s) 308 may be straight without any bend if the geometry of the bezel 300 and/or validation device housing allows for a straight flap 308 to be mounted such that the distal end 320 of the flap 308 is at an acute angle relative to the major side 314 of the slot 302 that the distal end 320 contacts in a default state. The distal end 320 may be positioned against an interior surface of one of the major sides 314 of the slot 302, while the mounting portion may be secured to an interior of the validator housing and/or entry bezel 300. As shown here, the mounting portion is secured to the housing and/or bezel 300 using a clamp plate 310. Clamp plate 310 may be configured to receive one or more fasteners 312 and may be used to clamp or otherwise secure the mounting portion of each flap 308 against the housing and/or entry bezel 300 such that the mounting portion is constrained while the distal end 320 of each flap 308 is unconstrained and may be flexed in a direction of the ticket travel.

As shown in FIGS. 3B-3E, the distal end 320 of at least one flap 308 may be positioned against an interior surface of the entry bezel 300. In particular, as shown in FIG. 3D, at least one flap 308 is positioned against a rear, interior surface of the slot 302. When in a default state (with the distal end 320 of the flap 308 at an acute angle relative to the relevant interior surface of the slot 302), the flap(s) 308 contacts and sits flush around all or part of the slot 302 such that the slot 302 (and the interior of the validation device) is sealed from the environment. As the ticket passes into the slot 302, it contacts a front surface 318 of at least one flap 308 where the ticket biases the at least one flap 308 away from the interior surface of the slot 302 just enough for the ticket to pass through the slot 302. The flap 308 then scrapes against a face of the ticket and removes water and/or other loose debris that is present on the flap-side surface of the ticket, while the interior surface of the slot 302 may perform the same function on an opposite surface of the ticket. As the ticket passes the flap(s) 308, the ticket engages with an acceptor assembly of the validator device, which grabs and transports the ticket to a ticket reader device. While shown here with the distal end 320 of the flap 308 positioned against a rear, interior surface of the slot 302, it will be appreciated that in some embodiments, the distal end 320 of the flap 308 may be positioned against a primary/major surface of the slot 302. For example, as shown, flap 308 may be positioned such that the distal end 320 is positioned against a top surface of the slot 302 with the distal end 320 at an acute angle relative to the relevant interior surface of the slot 302. While shown with flap(s) 308 positioned with the distal end 320 pointing upward, it will be appreciated that the flaps may be mounted in any desired orientation. One particular advantage of the illustrated configuration is that upon being scraped off, any water or other loose debris may be directed down the slope of the flap(s) 308 and down the slope of the lower surface 304 of the slot 302 and out of the validation device.

Figure 4:
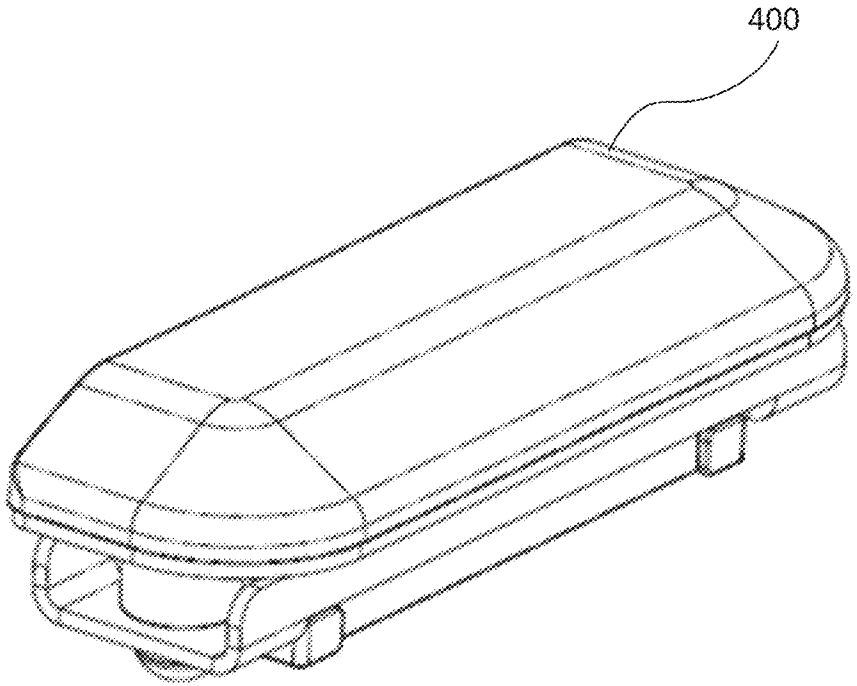
FIG. 4 depicts an exit bezel according to embodiments.
Figure 4A:
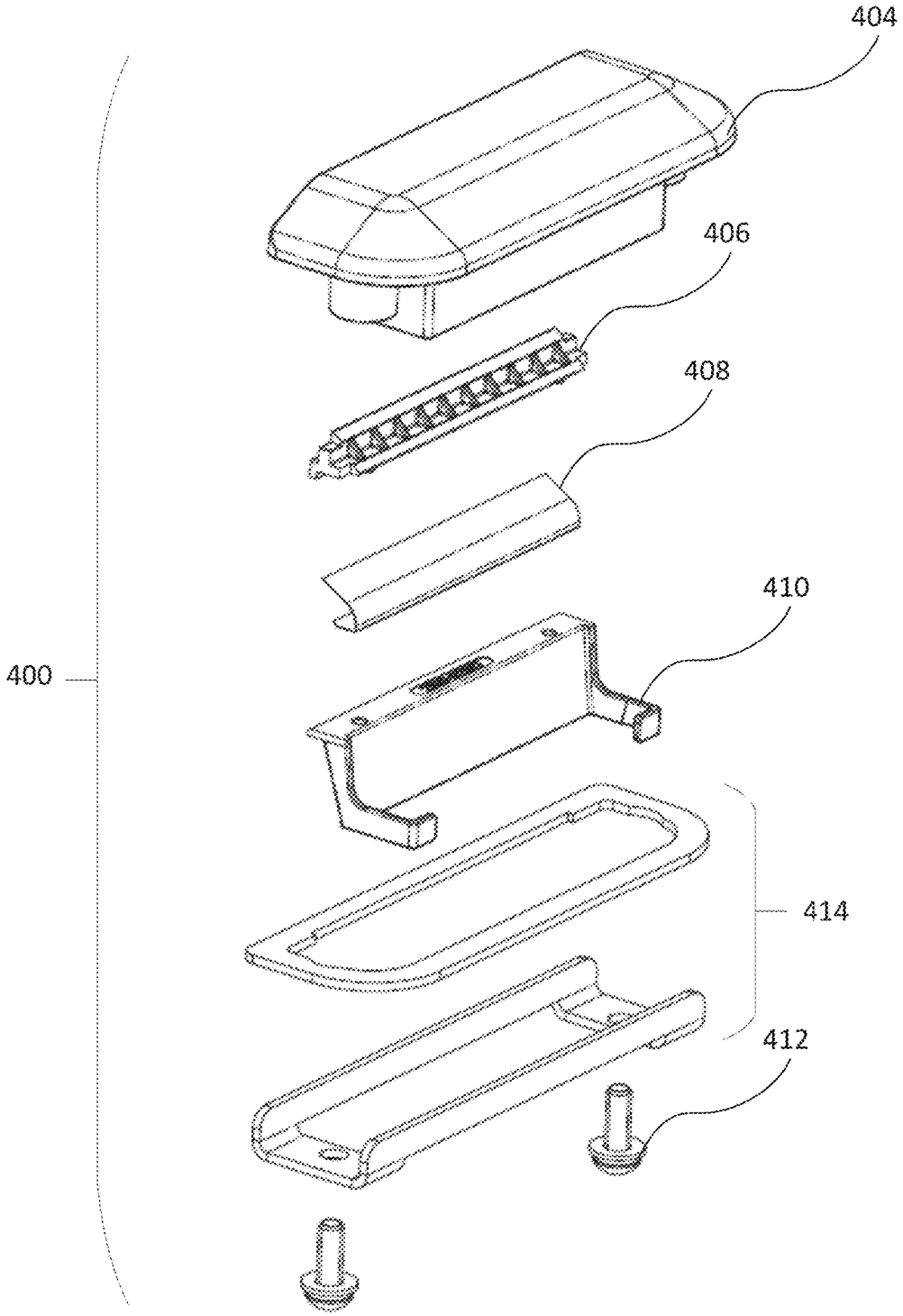
FIG. 4A is an exploded view of the entry bezel of FIG. 4.

FIG. 4 depicts an exit bezel 400, similar to exit bezel 104 and/or 204. Exit bezel 400 may be formed on a nose assembly and/or other portion of a validation device housing. The exit bezel 400 may define a slot 402 (best seen in FIGS. 4B and 4C) through which tickets and/or other media may be ejected after being validated. The exit bezel 400 and/or slot 402 be elongate and may include two major sides that are connected by connecting regions that extend between the major sides. As best illustrated in FIG. 4A, exit bezel 400 may include a bezel cover 404 that extends over the slot 402 such that the slot is shielded from above. The exit bezel 400 may also include a ticket guide 406 that is positioned below the bezel cover 404. In some embodiments, the slot 402 may be defined by at least a portion of the top surface of the ticket guide 406 and at least a portion of a bottom, interior surface of the bezel cover 404. Oftentimes, the exit bezel 400 is oriented such that the slot 402 is generally horizontal relative to the ground such that the bezel cover 404 overhangs beyond the slot 402 to help protect the slot 402 from falling water and/or other debris, although it will be appreciated that the slot 402 may be oriented in any manner depending on the desired application. Additionally, the slot 402 may be elevated above a top surface of the validation device such that standing water and/or other debris are not drawn into the slot 402.

Figure 4B:
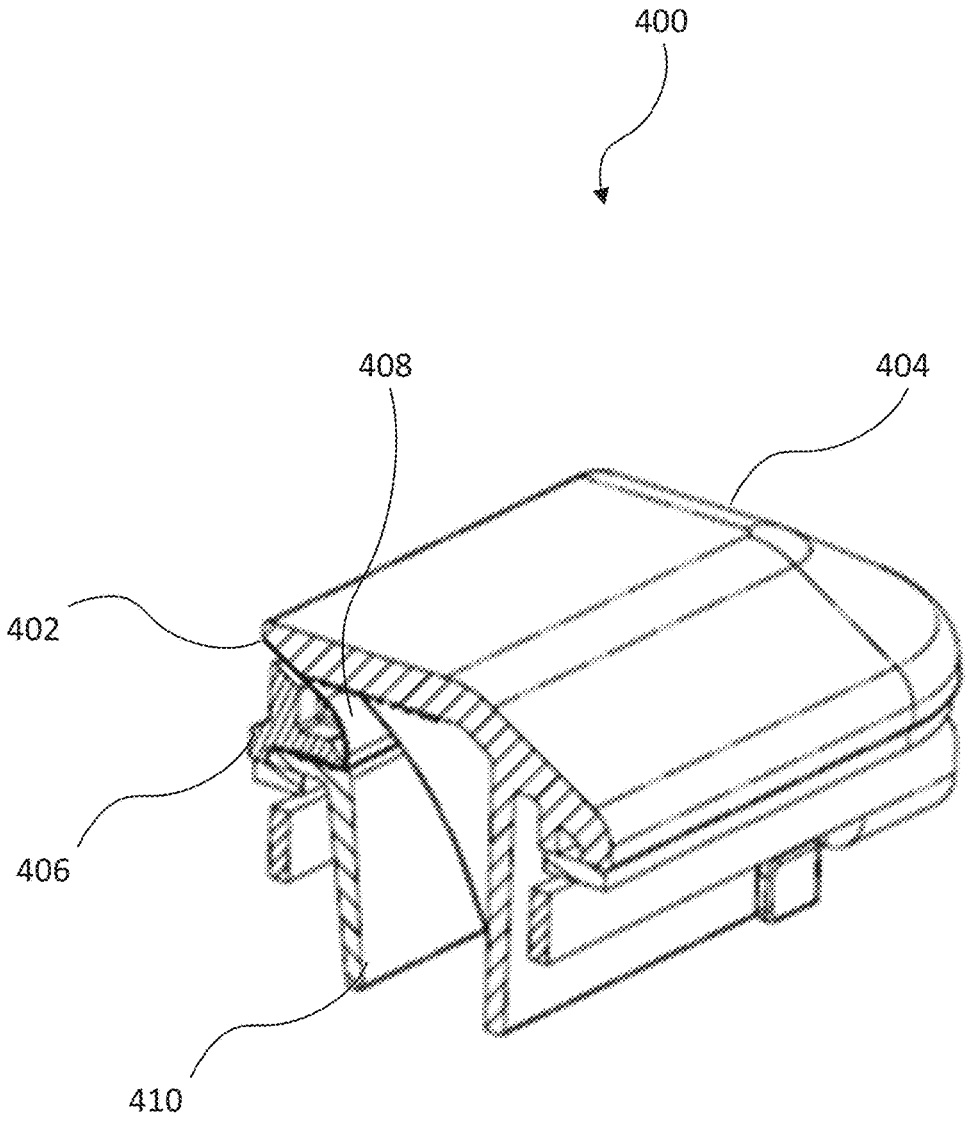
FIG. 4B is an isometric cross-sectional view of the entry bezel of FIG. 4.
Figure 4C:
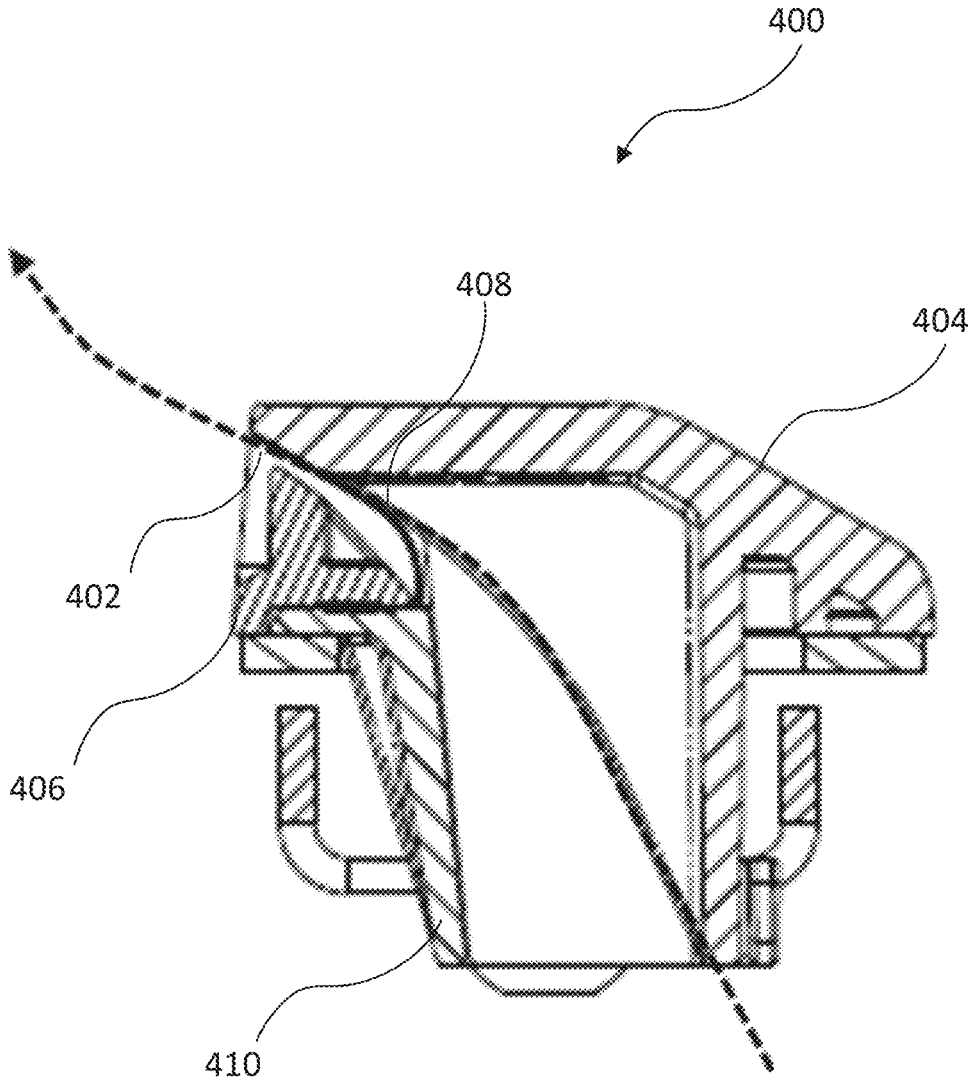
FIG. 4C is a side cross-sectional view of the entry bezel of FIG. 4.

At least one flap 408 may be positioned within the exit bezel 400 such that a distal end of the flap 408 is positioned within the slot 402 and contacts either the bottom surface of the bezel cover 404 or the top surface of the ticket guide 406 (as best illustrated in FIGS. 4B and 4C). While shown here with one flap 408, it will be appreciated that more than flap 408 may also be used to fit the needs of a particular application, such as to provide additional stiffness. Such an arrangement allows the flap 408 to flex to allow the ticket to pass through the exit bezel 400 while still being sufficiently stiff to scrape the surface of the ticket to maintain a seal at the exit bezel 400 and/or minimize any opening to prevent any water and/or loose debris from entering the slot 402 and to return to the default position after the ticket has passed the flap 408. Flap 408 may be formed of a metal, plastic, and/or other synthetic material, such as Mylar or a polycarbonate film. Flap 408 may be between approximately 0.05 mm and 0.10 mm thick and oftentimes about 0.08 mm. By using a thin Mylar (or similar material) flap 408, a flap 408 with a proper combination of stiffness and low friction is provided that allows tickets to slide past a distal edge of the flap(s) 408 while still being contacted by the flap 408 with sufficient force/tightness to scrape any water or other loose debris from the surface of the ticket and prevent it from entering the validation device.

As illustrated here, flap 408 may be bent such that each flap includes a distal end that is at an angle relative to a mounting portion. The angle of the bend may be based on the geometry of the exit bezel 400. For example, angle of the bend may be set such that the distal end of the flap 408 is at an acute angle relative to the major side of the slot 402 that the distal end contacts in a default state. In some embodiments, the flap(s) 408 may be straight without any bend if the geometry of the bezel 400 and/or validation device housing allows for a straight flap 408 to be mounted such that the distal end of the flap 408 is at an acute angle relative to the major side of the slot 402 that the distal end contacts in a default state. The distal end may be positioned against an interior surface of one of the major sides of the slot 402, while the mounting portion may be secured to an interior of the validator housing and/or exit bezel 400. As shown here, the mounting portion is secured to the housing and/or bezel 400 using a clamp plate 410. Clamp plate 410 may be configured to receive one or more fasteners 412 and may be used to clamp or otherwise secure the mounting portion of each flap 408 against a body 414 of the exit bezel 400 such that the mounting portion is constrained while the distal end of each flap 408 is unconstrained and may be flexed in a direction of the ticket travel. The body 414 is configured to mate with the bezel cover 404 and ticket guide 406 to form the exit bezel 400.

As shown in FIGS. 4B and 4C, the distal end of flap 408 may be positioned against an interior surface of the exit bezel 400. In particular, as shown in FIG. 4C, at least one flap 408 is positioned against a front, interior surface of the slot 402. When in a default state (with the distal end of the flap 408 at an acute angle relative to the relevant interior surface of the slot 402), the flap(s) 408 contacts and sits flush around all or part of the slot 402 such that the slot 402 (and the interior of the validation device) is sealed from the environment. As the ticket passes out of the slot 402, it contacts a rear surface of flap 408 such that the ticket biases the flap 408 away from the interior surface of the slot 402 just enough for the ticket to pass through the slot 402. The flap 408 then scrapes against a face of the ticket such that any gaps between the flap 408, ticket, and slot 402 are eliminated and/or minimized to prevent water and/or other debris from entering the slot 402. While shown here with the distal end of the flap 408 positioned against a front, top interior surface of the slot 402, it will be appreciated that in some embodiments, the distal end of the flap 408 may be positioned against a primary/major surface of the slot 402. For example, as shown, flap 408 may be positioned such that the distal end is positioned against a bottom surface of the slot 402 with the distal end at an acute angle relative to the relevant interior surface of the slot 402. While shown with flap(s) 408 positioned with the distal end pointing upward, it will be appreciated that the flap 408 may be mounted in any desired orientation. One particular advantage of the illustrated configuration is that upon being scraped off, any water or other loose debris may be directed downward by the flap(s) 408 onto an outer surface of the validation device.

Figure 5:
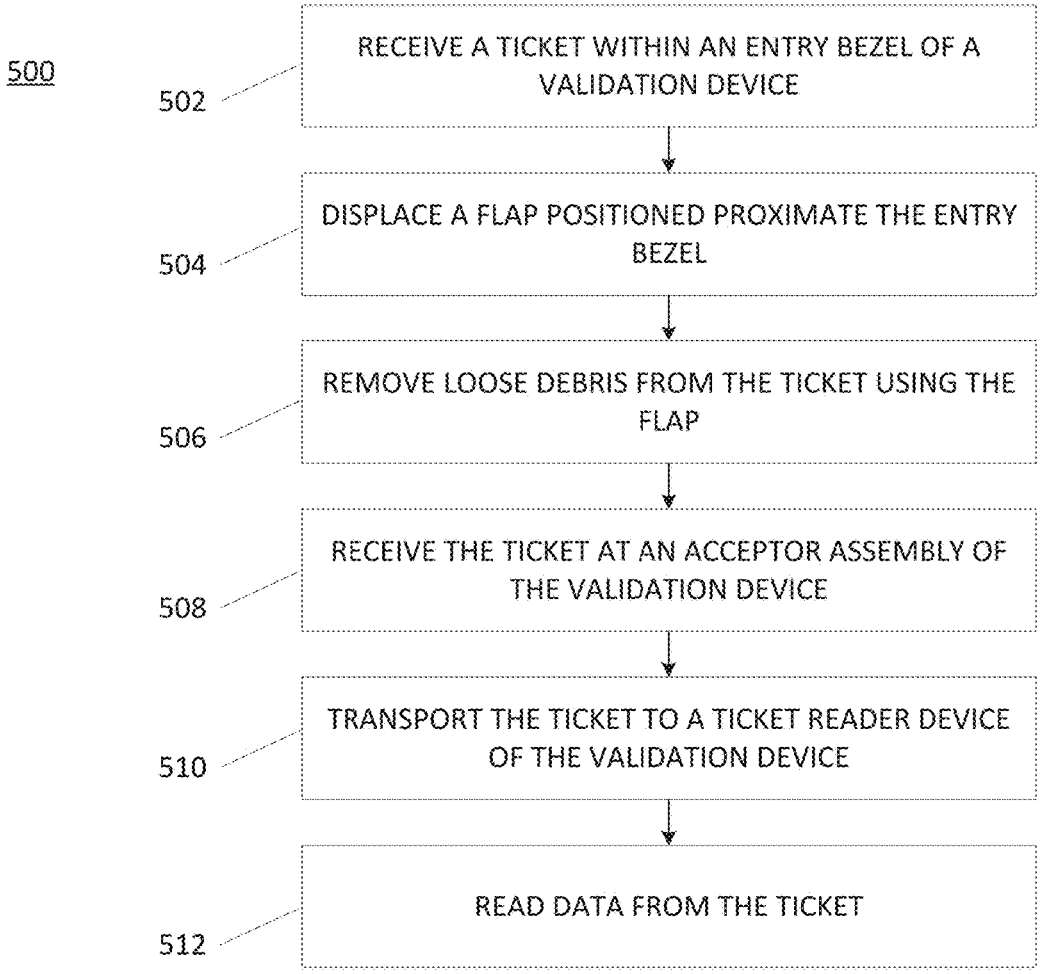
FIG. 5 is a flowchart of a process for protecting a validation device from debris ingression according to embodiments.

FIG. 5 depicts a process 500 for protecting a validation device from debris ingression according to one embodiment. Process 500 may be performed using any of the validation devices described herein and may begin at block 502 by receiving a ticket within a ticket entry bezel of the validation device. For example, a user may insert the ticket (or any other item to be validated, such as currency, card, or other data storage media) into the ticket entry bezel. Oftentimes, the ticket entry bezel is horizontally oriented such that the ticket is received in a generally horizontal orientation relative (with the faces of the ticket pointing up and down, respectively) to the validation device, although other arrangements are possible. At block 504, at least one flap positioned proximate the ticket entry bezel is displaced by insertion of the ticket through the ticket entry bezel. For example, in some embodiments this may involve the flap(s) being moved out of contact with the one of the major sides of the bezel slot. The flap may be similar to those described herein and may be configured to be biased against at least one major surface of a slot of the ticket entry bezel so as to effectively seal an interior of the validation device from the environment when in a default position. The flap(s) may be secured within the bezel/validation device using a clamp plate that is configured to constrain a proximal end of each flap against a portion of the validator housing while leaving the distal end of the at least one flap unconstrained.

At block 506, any loose debris on the ticket may be removed by the at least one flap. For example, as the ticket passes the flap(s), the distal edge of at least one flap may scrape against a face of the ticket to remove any debris, such as water or dirt, which may be directed away from the slot to prevent the debris from entering the validation device. As the ticket passes the flap(s) (or after the ticket passes the flap(s)), the ticket is received at an acceptor assembly positioned interiorly of the at least one flap at block 508. The acceptor assembly may transport the ticket to a ticket reader device of the validation device at block 510 where information encoded and/or otherwise written onto a storage region of the ticket (for currency or checks this could be magnetic ink or other detectable features) is read from the ticket at block 512.

In some embodiments, the validation device may be a pass through device. In such embodiments, the validation device may include a ticket exit bezel that is configured to eject the ticket after the data has been read. For example, in some embodiments, process 500 may include passing the ticket through the ticket exit bezel of the validation device and displacing an additional flap positioned proximate the ticket exit bezel as the ticket passes through the ticket exit bezel. Along with (or instead of) providing the ticket after the data read process, the an audio and/or visual indication of a validation result may be providing, such as by using one or more feedback devices, based on the data read from the ticket.

Figure 6:
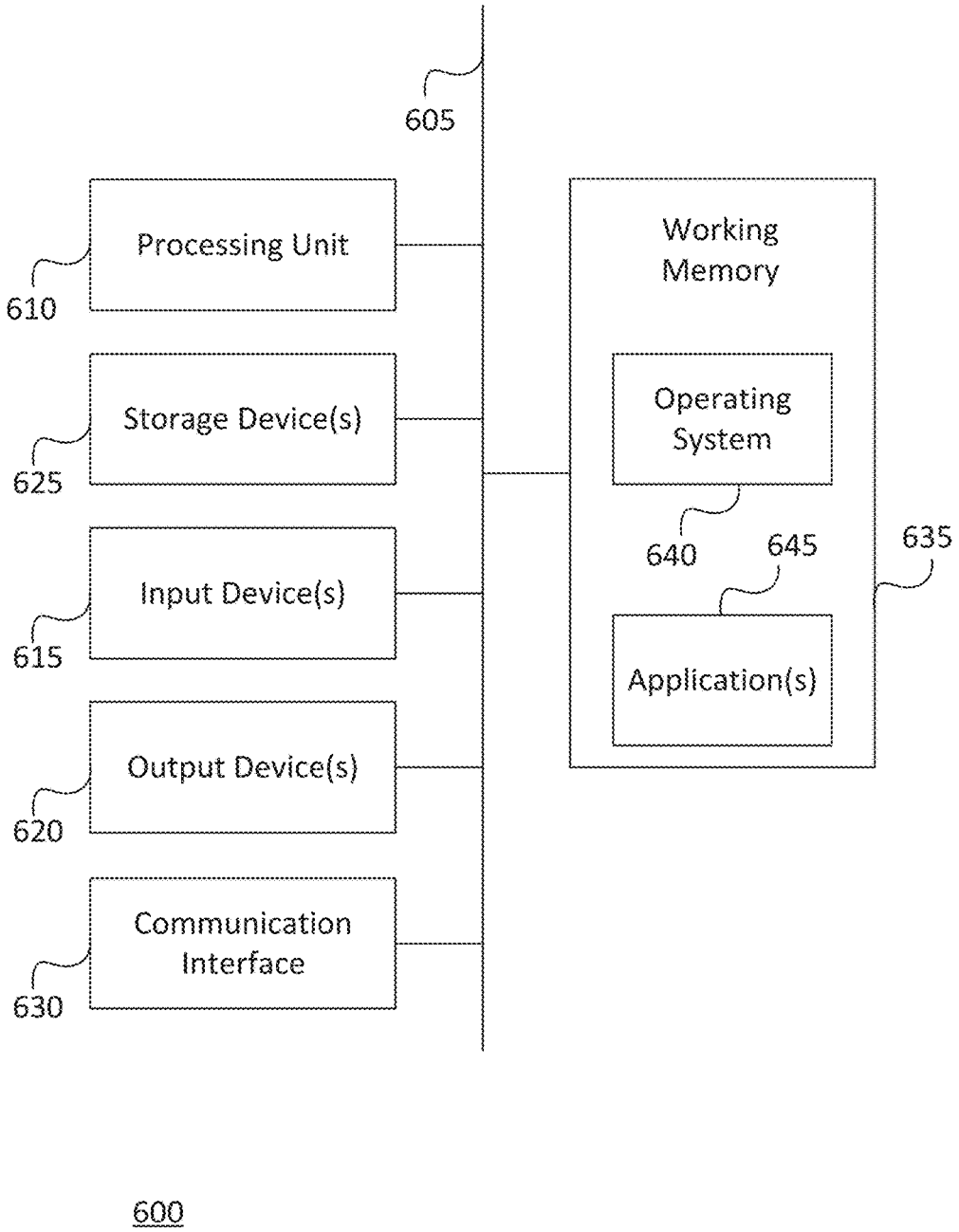
FIG. 6 is a block diagram of an example computing system according to embodiments.

A computer system as illustrated in FIG. 6 may be incorporated as part of the previously described computerized devices. For example, computer system 600 can represent some of the components of the validation device, the ticket reader device, and the like described herein. FIG. 6 provides a schematic illustration of one embodiment of a computer system 600 that can perform the methods provided by various other embodiments, as described herein. FIG. 6 is meant only to provide a generalized illustration of various components, any or all of which may be utilized as appropriate. FIG. 6, therefore, broadly illustrates how individual system elements may be implemented in a relatively separated or relatively more integrated manner.

The computer system 600 is shown comprising hardware elements that can be electrically coupled via a bus 605 (or may otherwise be in communication, as appropriate). The hardware elements may include a processing unit 610, including without limitation one or more processors, such as one or more special-purpose processors (such as digital signal processing chips, graphics acceleration processors, and/or the like); one or more input devices 615, which can include without limitation a keyboard, a touchscreen, receiver, a motion sensor, a camera, a smartcard reader, a contactless media reader, and/or the like; and one or more output devices 620, which can include without limitation a display device, a speaker, a printer, a writing module, and/or the like.

The computer system 600 may further include (and/or be in communication with) one or more non-transitory storage devices 625, which can comprise, without limitation, local and/or network accessible storage, and/or can include, without limitation, a disk drive, a drive array, an optical storage device, a solid-state storage device such as a random access memory ("RAM") and/or a read-only memory ("ROM"), which can be programmable, flash-updateable and/or the like. Such storage devices may be configured to implement any appropriate data stores, including without limitation, various file systems, database structures, and/or the like.

The computer system 600 might also include a communication interface 630, which can include without limitation a modem, a network card (wireless or wired), an infrared communication device, a wireless communication device and/or chipset (such as a Bluetooth™ device, an 502.11 device, a Wi-Fi device, a WiMAX device, an NFC device, cellular communication facilities, etc.), and/or similar communication interfaces. The communication interface 630 may permit data to be exchanged with a network (such as the network described below, to name one example), other computer systems, and/or any other devices described herein. In many embodiments, the computer system 600 will further comprise a non-transitory working memory 635, which can include a RAM or ROM device, as described above.

The computer system 600 also can comprise software elements, shown as being currently located within the working memory 635, including an operating system 640, device drivers, executable libraries, and/or other code, such as one or more application programs 645, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such special/specific purpose code and/or instructions can be used to configure and/or adapt a computing device to a special purpose computer that is configured to perform one or more operations in accordance with the described methods.

A set of these instructions and/or code might be stored on a computer-readable storage medium, such as the storage device(s) 625 described above. In some cases, the storage medium might be incorporated within a computer system, such as computer system 600. In other embodiments, the storage medium might be separate from a computer system (e.g., a removable medium, such as a compact disc), and/or provided in an installation package, such that the storage medium can be used to program, configure and/or adapt a special purpose computer with the instructions/code stored thereon. These instructions might take the form of executable code, which is executable by the computer system 600 and/or might take the form of source and/or installable code, which, upon compilation and/or installation on the computer system 600 (e.g., using any of a variety of available compilers, installation programs, compression/decompression utilities, etc.) then takes the form of executable code.

Substantial variations may be made in accordance with specific requirements. For example, customized hardware might also be used, and/or particular elements might be implemented in hardware, software (including portable software, such as applets, etc.), or both. Moreover, hardware and/or software components that provide certain functionality can comprise a dedicated system (having specialized components) or may be part of a more generic system. For example, a risk management engine configured to provide some or all of the features described herein relating to the risk profiling and/or distribution can comprise hardware and/or software that is specialized (e.g., an application-specific integrated circuit (ASIC), a software method, etc.) or generic (e.g., processing unit 610, applications 645, etc.) Further, connection to other computing devices such as network input/output devices may be employed.

Some embodiments may employ a computer system (such as the computer system 600) to perform methods in accordance with the disclosure. For example, some or all of the procedures of the described methods may be performed by the computer system 600 in response to processing unit 610 executing one or more sequences of one or more instructions (which might be incorporated into the operating system 640 and/or other code, such as an application program 645) contained in the working memory 635. Such instructions may be read into the working memory 635 from another computer-readable medium, such as one or more of the storage device(s) 625. Merely by way of example, execution of the sequences of instructions contained in the working memory 635 might cause the processing unit 610 to perform one or more procedures of the methods described herein.

The terms "machine-readable medium" and "computer-readable medium," as used herein, refer to any medium that participates in providing data that causes a machine to operate in a specific fashion. In an embodiment implemented using the computer system 600, various computer-readable media might be involved in providing instructions/code to processing unit 610 for execution and/or might be used to store and/or carry such instructions/code (e.g., as signals). In many implementations, a computer-readable medium is a physical and/or tangible storage medium. Such a medium may take many forms, including but not limited to, non-volatile media, volatile media, and transmission media. Non-volatile media include, for example, optical and/or magnetic disks, such as the storage device(s) 625. Volatile media include, without limitation, dynamic memory, such as the working memory 635. Transmission media include, without limitation, coaxial cables, copper wire, and fiber optics, including the wires that comprise the bus 605, as well as the various components of the communication interface 630 (and/or the media by which the communication interface 630 provides communication with other devices). Hence, transmission media can also take the form of waves (including without limitation radio, acoustic and/or light waves, such as those generated during radio-wave and infrared data communications).

Common forms of physical and/or tangible computer-readable media include, for example, a magnetic medium, optical medium, or any other physical medium with patterns of holes, a RAM, a PROM, EPROM, a FLASH-EPROM, any other memory chip or cartridge, a carrier wave as described hereinafter, or any other medium from which a computer can read instructions and/or code.

The communication interface 630 (and/or components thereof) generally will receive the signals, and the bus 605 then might carry the signals (and/or the data, instructions, etc. carried by the signals) to the working memory 635, from which the processor(s) 605 retrieves and executes the instructions. The instructions received by the working memory 635 may optionally be stored on a non-transitory storage device 625 either before or after execution by the processing unit 610.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. Furthermore, embodiments of the methods may be implemented by hardware, software, firmware, middleware, microcode, hardware description languages, or any combination thereof. When implemented in software, firmware, middleware, or microcode, the program code or code segments to perform the associated tasks may be stored in a computer-readable medium such as a storage medium. Processors may perform the associated tasks.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A ticket validation device that is protected from debris ingression, comprising:

a validator housing defining a ticket entry bezel, the ticket entry bezel defining a first major side, a second major side positioned opposite the first major side, and shorter connecting regions that extend between the first major side and the second major side, wherein the first major side, the second major side, and the shorter connecting regions define a slot;

an acceptor assembly configured to transport a ticket to a ticket reader device; and at least one flap positioned between the acceptor assembly and the ticket entry bezel, wherein:

the at least one flap is biased against one of the first major side or the second major side of the ticket entry bezel;

a medial portion of the flap is positioned flush against edges of the slot to seal the ticket entry bezel in a default position; and a front surface of the at least one flap is configured to be pushed away from the one of the first major side and the second major side by the ticket when inserted into the ticket entry bezel such that the ticket scrapes between a distal end of the at least one flap and the one of the first major side and the second major side to remove any loose debris from the ticket prior to the ticket reaching the acceptor assembly.

2. The ticket validation device that is protected from debris ingression of claim 1, wherein:

the at least one flap comprises a first flap and a second flap that are staggered relative to one another such that the distal end of the first flap extends beyond the distal end of the second flap.

3. The ticket validation device that is protected from debris ingression of claim 1, wherein:

the at least one flap is bent such that the distal end of the at least one flap is angled toward the one of the first major side and the second major side.

4. The ticket validation device that is protected from debris ingression of claim 1, wherein:

the at least one flap comprises Mylar.

5. The ticket validation device that is protected from debris ingression of claim 1, further comprising:

a clamp plate configured to constrain a proximal end of the at least one flap against a portion of the validator housing while leaving the distal end of the at least one flap unconstrained.

6. The ticket validation device that is protected from debris ingression of claim 1, further comprising:

a ticket exit bezel that is configured to eject the ticket from the validator housing after the ticket passes through the ticket reader device.

7. A ticket validation device that is protected from debris ingression, comprising:

a validator housing defining a ticket entry bezel, the ticket entry bezel defining a first major side, a second major side positioned opposite the first major side, and shorter connecting regions that extend between the first major side and the second major side, wherein the first major side, the second major side, and the shorter connecting regions define a slot;

an acceptor assembly configured to transport a ticket to a ticket reader device; and a first flap and a second flap positioned between the acceptor assembly and the ticket entry bezel, wherein:

the first flap and the second flap are biased in a direction of one of the first major side or the second major side of the entry bezel;

a medial portion of one of the first and second flaps is positioned flush against edges of the slot to seal the ticket entry bezel in a default position; and a front surface of the flap is configured to be pushed away from the one of the first major side and the second major side by the ticket when inserted into the ticket entry bezel such that the ticket scrapes between a distal end of the first flap and the one of the first major side and the second major side to remove any loose debris from the ticket prior to the ticket reaching the acceptor assembly.

8. The ticket validation device that is protected from debris ingression of claim 7, wherein:

the one of the first major side and the second major side comprises a bottom side and the other of the first major side and second major side comprises a top side;

the first flap and the second flap are mounted with the bottom side of the ticket entry bezel and are bent upward toward the top side.

9. The ticket validation device that is protected from debris ingression of claim 7, wherein:

an opening defined by the ticket entry bezel is oriented in a horizontal direction.

* * * * *